US005788556A

United States Patent [19]

Morace

[11] Patent Number: 5,788,556

[45] Date of Patent: Aug. 4, 1998

[54] ILLUMINATED STACKED BEAD ART TOY

[75] Inventor: Ruth G. Morace, Oyster Bay, N.Y.

[73] Assignee: Western Trimming Corporation, Chatsworth, Calif.

[21] Appl. No.: 797,575

[22] Filed: Feb. 7, 1997

Related U.S. Application Data

[63] Continuation-in-part of Ser. No. 778,549, Jan. 3, 1997, abandoned.

[51] Int. Cl.[6] ..... A63H 33/22; A63H 33/04; A63H 33/26

[52] U.S. Cl. ..... 446/219; 446/85; 446/485; 40/576; 362/32; 434/204

[58] Field of Search ..... 40/576, 574; 362/32, 362/806, 812; 434/172–174, 203–204; 446/85, 117, 219, 485

[56] References Cited

U.S. PATENT DOCUMENTS

| | | | |
|---|---|---|---|
| 1,775,151 | 9/1930 | Auerbach | 40/576 |
| 3,094,792 | 6/1963 | Morgan et al. | 446/117 |
| 3,629,655 | 12/1971 | Fullmer | 362/812 |
| 3,921,330 | 11/1975 | Drieze | 446/117 |
| 4,218,603 | 8/1980 | Satoh | 362/812 |
| 4,891,030 | 1/1990 | Gertzfeld | 446/118 |
| 4,917,448 | 4/1990 | Oppenheimer | 350/96.1 |
| 5,128,784 | 7/1992 | Abileah et al. | 359/49 |
| 5,295,221 | 3/1994 | Roslan | 385/147 |
| 5,391,105 | 2/1995 | Jones | 446/219 |
| 5,426,879 | 6/1995 | Hecker | 40/427 |

FOREIGN PATENT DOCUMENTS

| | | | |
|---|---|---|---|
| 2312079 | 12/1976 | France | 434/173 |
| 2010102 | 6/1979 | United Kingdom | 446/75 |

*Primary Examiner*—Robert A. Hafer
*Assistant Examiner*—Laura Fossum
*Attorney, Agent, or Firm*—Kenneth P. Glynn, Esq.

[57] ABSTRACT

An illuminable toy device has a main housing for supporting a light source, a reflective sheet, a diffusion screen and a plurality of at least translucent elongated rods. It also includes a light source which is connected to the main housing which includes at least one light, a power source for illumination of the light, and an on/off control switch for the power source. There is a reflective sheet in front of the light. There is also a diffusion screen located in front of the reflective sheet. A plurality of at least translucent elongated rods connected to the main housing are adapted to receive a plurality of orificed beads thereon in a stacked fashion. There is also a plurality of at least translucent and opaque beads, each having an orifice therein of sufficient size to permit placement of each onto one of the elongated rods in a stacked fashion. Each of the beads have a predetermined color and are stackable onto the rods to create a unique, illuminable artistic creation.

16 Claims, 3 Drawing Sheets

ILLUMINATED STACKED BEAD ART TOY

REFERENCE TO RELATED APPLICATION

This application is a Continuation-in-Part of application Ser. No. 08/778,549, filed on Jan. 3, 1997, now abandoned.

BACKGROUND OF THE INVENTION

1. Field of the Invention

This invention relates to illuminable toys and, more specifically, to such toys which offer creative opportunities for children to make artistic creations by unique stacking assemblage of orificed beads onto rods against a lighted background screen. The present invention toys encourage dexterity development and artistic development and can be used repeatedly to create different artistic presentations.

2. Information Disclosure Statement

Toys relating to the use of beads have been around for many centuries and such toys overlap crafts, the primary difference being that, as toys, beads are used for entertainment and, as crafts, are used for artistic and utilitarian purposes. Thus, children have been using beads to make simulated jewelry such as necklaces, to make decorations for Christmas trees and for other purposes for quite some time.

The use of illumination for toys has been around for a number of decades and children enjoy the pleasures of illuminable toys which are attached to flashlights, illuminable toys such as toy swords and guns and illuminable play houses and even illuminable projection toys.

Notwithstanding the prior art, the present invention utilizing three different aspects of creativity and amusement in combination, namely the use of beading rods, the ability to create scenes or pictures, and illumination, have not been taught in combination nor have been suggested or rendered obvious by the prior art.

SUMMARY OF THE INVENTION

An illuminable toy device has a main housing for supporting a light source, a reflective sheet, a diffusion screen and a plurality of at least translucent elongated rods. It also includes a light source which is connected to the main housing which includes at least one light, a power source for illumination of the light, and an on/off control switch for the power source. There is also a reflective sheet located in front of the light and a diffusion screen in front of the reflective sheet. A plurality of at least translucent elongated rods connected to the main housing are adapted to receive a plurality of orificed beads thereon in a stacked fashion. There is also a plurality of at least translucent and opaque beads, each having an orifice therein of sufficient size to permit placement of each onto one of the elongated rods in a stacked fashion. Each of the beads have a predetermined color and are stackable onto the rods to create a unique, illuminable artistic creation.

BRIEF DESCRIPTION OF THE DRAWINGS

The present invention should be more fully understood when the specification herein is taken in conjunction with the drawings appended hereto wherein.

DETAILED DESCRIPTION OF THE PRESENT INVENTION

The present invention involves an illuminated bead art toy and may be more specifically be described as a toy device which includes a main housing, a lighting source, a reflective sheet, a diffusion screen, a plurality of rods and a plurality of orificed beads adapted to fit onto the rods.

The main housing is for supporting the lighting source, the reflective sheet, the diffusion screen and the rods. Such support may be by direct connection or indirect connection and the main housing may include significant additional features. It may be made of plastic, metal, or other material, but for mass production, efficiencies, and economics, would preferably be made of plastic.

The main housing may simply be a frame which supports the lighting source, the reflective sheet, the diffusion screen and the rods, but preferably embodies a practical and aesthetically pleasing form and may, for example, take the form of a box, case or hinged box. This will become more apparent in the discussion of the drawings below.

The light source is connected to the main housing and has at least one light, a power source, and a control switch. For example, two, three, or four lights may be utilized. These lights are connected to a power source and an on/off switch for the power source. The power source may be batteries contained within the device and may alternatively be solar chargeable, or may be a.c. or other electrical current (a plug-in device).

Located in front of the lighting source is a reflective sheet and located in front of the reflective sheet is a diffusion screen and located in front of the diffusion screen is a plurality of translucent, elongated rods. The reflective sheet reflects light across the are of the diffusion screen. The diffusion screen diffuses the light over an area sufficient to backlight the collection of rods. Thus, the reflective sheet will generally be shaped to offer the greatest amount of reflective light across the area of the diffusion screen. The diffusion screen will generally be square or rectangular to accommodate the rods. In other words, if the rods are straight, parallel and in a single plane, the screen will have a similar configuration. Although not optimally economical, the rods themselves could be curved or of different lengths and could even be in a non-flat plane and the diffusion screen could be designed to accommodate such a configuration, e.g. a curved or arced plane.

The plurality of elongated rods must be at least translucent. By "at least translucent" is meant translucent or transparent so that at least some light passes therethrough.

Figure 1:
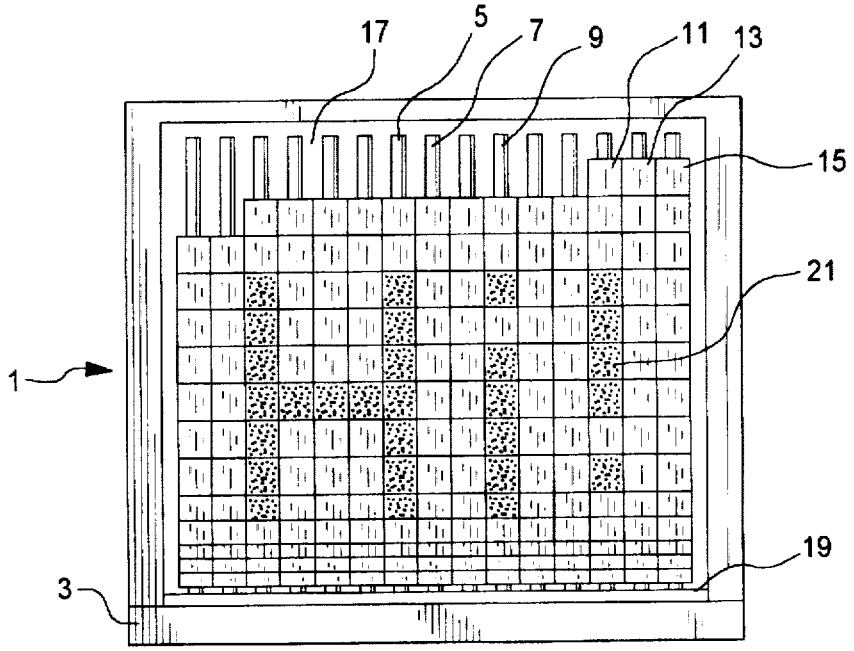
FIG. 1 is a front view of a single unit present invention illuminated bead art toy device.
Figure 2:
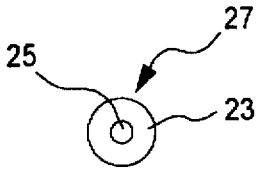
FIGS. 2, 3 and 4 illustrate different shapes for bead components of present invention devices.
Figure 3:
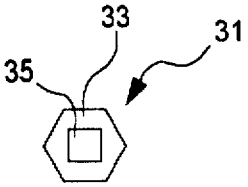
Figure 4:
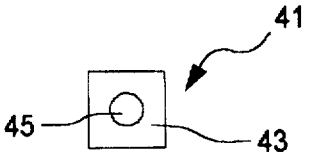

FIG. 1 shows a front view of present invention illuminated bead art toy device 1. Thus, device 1 has a main housing 3 for supporting a light source (not shown), in front of the light source (not shown) is a reflective screen (not shown). In front of the reflective screen is a diffusion screen 17 and in front of diffusion screen 17 are a plurality of transparent elongated rods such as rods 5, 7 and 9. These rods are stiff and straight and are hingedly connected to rotating shaft 19. They are parallel and equally spaced and are adapted to receive a plurality of translucent and opaque beads which stack like beads 11, 13 and 15. These beads have an orifice of sufficient size to permit placement onto the elongated rods. By selecting different colored beads, pictures or words may be created and illuminated for an attractive presentation. In this case all of the beads shown have been of a single color except for the beads such as bead 21, which are stacked to form "HI?". FIGS. 2, 3 and 4 respectively show various types of beads which may be used. FIG. 2 shows a circular bead 27 having a donut structure 23 with orifice 25; FIG. 4 shows a hexagonal bead 31 with a hexagonal outer shape 33 and a square orifice 35 adapted to fit over elongated rods having square cross sections. FIG. 4 shows a square bead 41 with a structure 43 having a circular orifice 45 as with the elongated rods, all of these beads are used to make the pattern. Transparent beads allow light to pass therethrough while opaque beads block light from passing through the beads. Further, for maximum light transmission, the rods will be clear transparent rods and the beads used to make the pattern would be a mixture of clear and colored transparent beads or translucent beads, the colored beads being of a plurality of colored selections.

Figure 5:
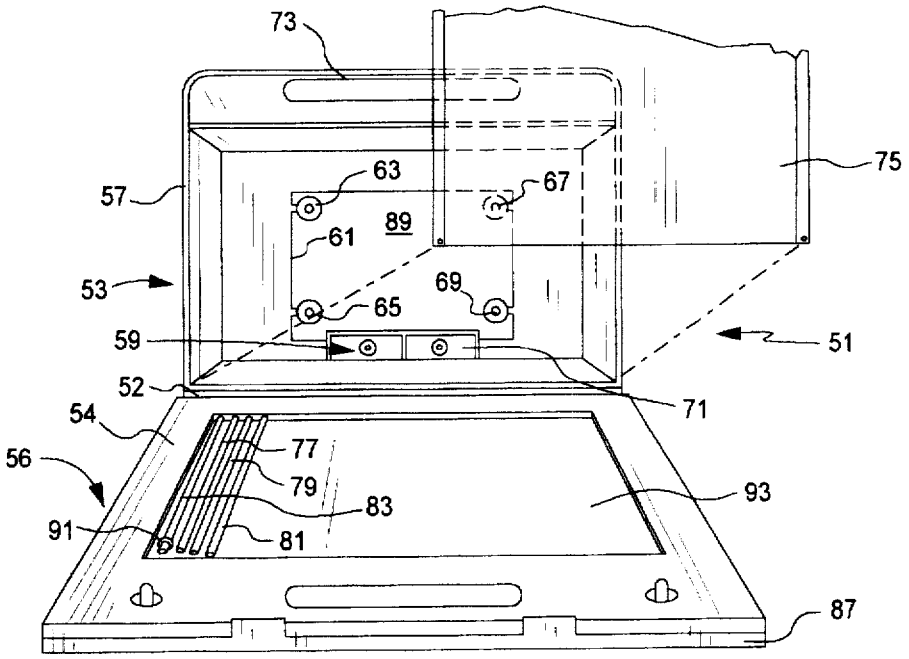
FIG. 5 shows an oblique frontal view of a present invention toy device with a hinged back and separately hinged elongated rods.

FIG. 5 shows a front, oblique view of an alternative present invention toy device 51. This includes a main frame 53 and a lower frame 56. Main frame 53 includes a power source shown generally as power source 59 which includes wiring 61, bulbs 63, 65, 67 and 69, batteries such as battery 71, a reflective sheet 89, an upper lid 57 and a handle 73. Lower frame 56 includes a bottom container 87 and a lower lid 54.

Shown removed is diffusion screen 75 which snaps into main frame 53 as shown by the dotted arrows. Diffusion screen 75 may be serrated translucent or transparent plastic or fine screen or other light diffusing material, so as to spread the light of the bulbs from the reflective sheet over the diffusion screen. Lower lid 54 has a recess area 93 for holding patterns (not shown) for outlining placement of different colored translucent and opaque beads.

Extending over lower lid 54 is a plurality of elongated rods 77, 79, 81 and 83 which are hingedly connected to rotating shaft 52. A plurality of beads such as 91 are placed on the plurality of rods 77, 79, 81 and 83. Each bead 91 is chosen and placed to match a bead on the pattern (not shown) which is placed in the recess area 93.

Figure 6:
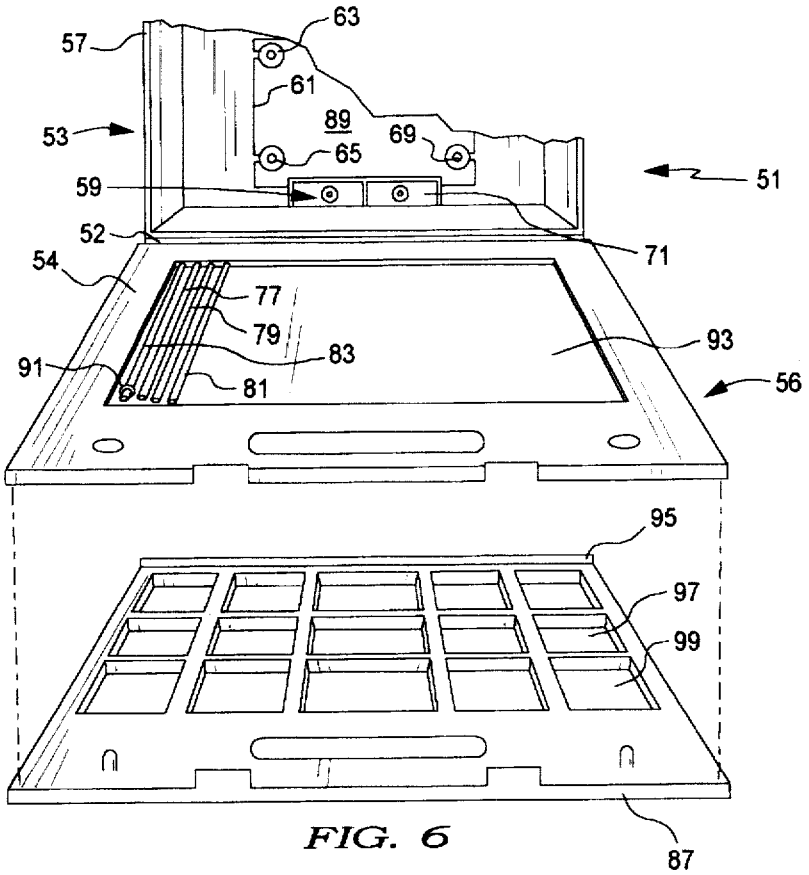
FIG. 6 shows another oblique frontal view of the present invention toy device shown in FIG. 5, but with the bottom container shown separated from the lower lid.

FIG. 6 shows a partial oblique frontal view of the present invention toy device 51 shown in FIG. 5 with identical parts identically numbered, except that the bottom container 87 is separated from bottom lid 54 to expose the inside of the bottom container 87. As can be seen in FIG. 6, hinge 52 is connected to bottom container 87 and would normally connect to either lower lid 54 or upper lid 57, or both. Bottom container 87 contains a plurality of recessed trays exemplified by trays 97 and 99 for holding and storing beads of different colors.

Figure 7:
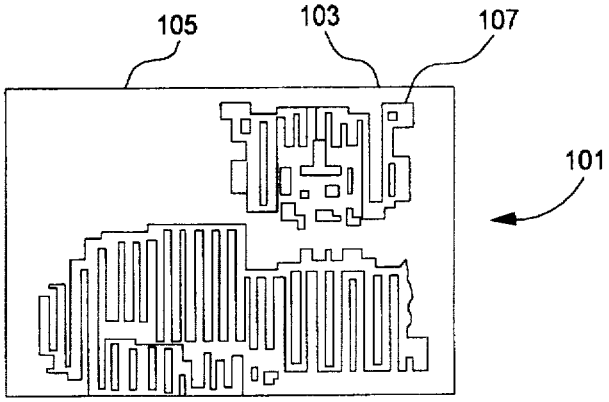
FIGS. 7 and 8 show front views of beaded rods to illustrate various artistic creations.
Figure 8:
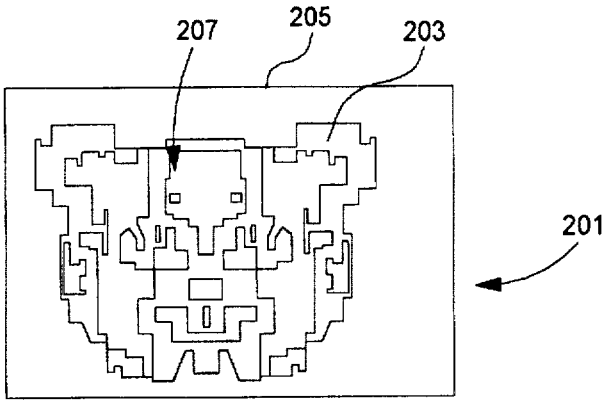

FIGS. 7 and 8 show frontal views of rods and beads to create artwork 101 and 201 respectively. Thus, in FIG. 7, the transparent or translucent 103 contrast to opaque beads 105 so that the cat shown generally as 107 may be illuminated for a dramatic artistic effect. Likewise, in FIG. 8, transparent or translucent beads 203 contrast with opaque beads 205 to create a teddy bear face shown generally as 207.

Figure 9:
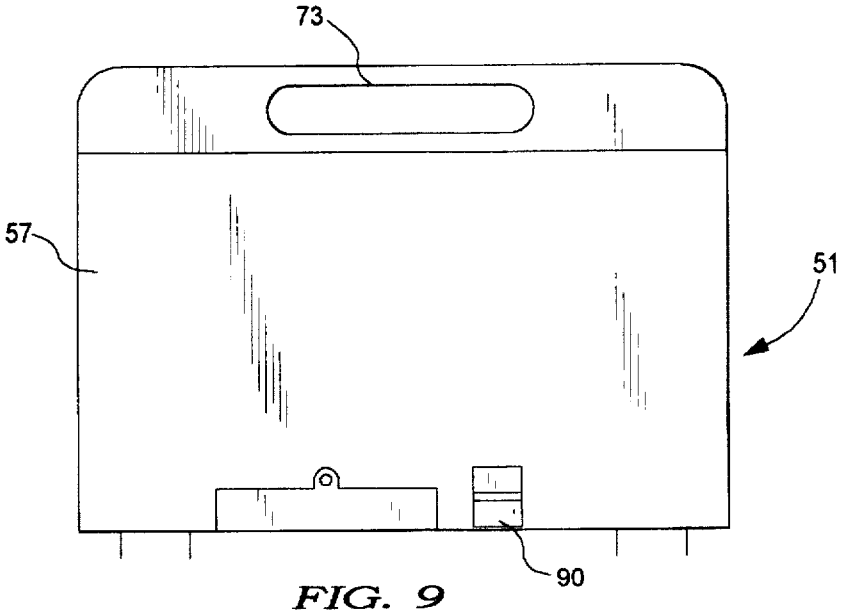
FIG. 9 shows a rear view of the present invention toy device in a closed position, having a control switch as shown.

FIG. 9 shows a rear view of the present invention toy device 51 as shown in FIG. 5 with identical parts identically numbered, except that the main housing is in a closed position. On the rear of lid 57 is a control switch 90 which connects to power source 59 (see FIG. 5) for turning the device on and off.

Obviously, numerous modifications and variations of the present invention are possible in light of the above teachings. It is therefore understood that within the scope of the appended claims, the invention may be practiced otherwise than as specifically described herein.

What is claimed is:

1. An illuminable toy device, which comprises:

(a) a main housing for supporting a light source, a reflective sheet, a diffusion screen and a plurality of non-opaque elongated rods, said main housing including a back and a front;

(b) a light source connected to said main housing which includes at least one light, a power source for illumination of said at least one light, and an on/off control switch for said power source;

(c) a reflective sheet located so as to permit transmission of light from said light source;

(d) a diffusion screen located relative to said reflective sheet and said light source such that said at least one light is located between said reflective sheet and said diffusion screen;

(e) a plurality of non-opaque elongated rods connected to said main housing and adapted to receive a plurality of orificed beads thereon in a stacked fashion; and (f) a plurality of beads, each bead having an orifice therein of sufficient size to permit placement of each bead onto one of said elongated rods in a stacked fashion, wherein each of said beads have a predetermined color, is configured to be stacked onto said rods to create a unique, illuminable artistic illustration and is transparent or opaque.

2. The illuminable toy device of claim 1 wherein said diffusion screen has a flat, single plane, front surface and said elongated rods are aligned in a row so as to be placeable parallel to said front surface of said elongated rods.

3. The illuminable toy device of claim 1 wherein said elongated rods are hingedly mounted to said main-housing for rotational movement toward and away from said diffusion screen.

4. The illuminable toy device of claim 2 wherein said elongated rods are hingedly mounted to said main housing for rotational movement toward and away from said diffusion screen.

5. The illuminable toy device of claim 1 wherein said light source is self-contained and includes at least one bulb, at least one battery as a power source for illumination.

6. The illuminable toy device of claim 1 wherein said-main housing has a general configuration of a container and lid and said lid is hingedly connected to said container.

7. The illuminable toy device of claim 6 wherein said lid contains said light source, said reflective sheet and said diffusion screen.

8. The illuminable toy device of claim 7 wherein said diffusion screen has a flat, single plane, front surface and said elongated rods are aligned in a row so as to be placeable parallel to said front surface of diffusion screen.

9. The illuminable toy device of claim 6 wherein said elongated rods are hingedly mounted to said main housing for rotational movement toward and away from said diffusion screen.

10. The illuminable toy device of claim 7 wherein said elongated rods are hingedly mounted to said main housing for rotational movement toward and away from said diffusion screen.

11. The illuminable toy device of claim 8 wherein said elongated rods are hingedly mounted to said main housing for rotational movement toward and away from said diffusion screen.

12. An illuminable toy device, which comprises:

(a) a main housing for supporting a light source, a reflective sheet, a diffusion screen and a plurality of non-opaque elongated rods, said main housing including a hinged upper lid and a hinged lower lid;

(b) a light source connected to said main housing which includes at least one light, a power source for illumination of said at least one light, and an on/off control switch for said power source;

(c) a reflective sheet located so as to permit transmission of light from said light source;

(d) a diffusion screen located relative to said reflective sheet and said light source such that said at least one light is located between said reflective sheet and said diffusion screen;

(e) a plurality of non-opaque elongated rods connected to said main housing and adapted to receive a plurality of orificed beads thereon in a stacked fashion; and (f) a plurality of beads, each bead having an orifice therein of sufficient size to permit placement of each bead onto one of said elongated rods in a stacked fashion, wherein each of said beads have a predetermined color, is configured to be stacked onto said rods to create a unique, illuminable artistic illustration and is transparent or opaque.

13. The illuminable toy device of claim 12 wherein said diffusion screen has a flat, single plane, front surface and said elongated rods are aligned in a row so as to be placeable parallel to said front surface of said elongated rods.

14. The illuminable toy device of claim 12 wherein said light source is self-contained and includes at least one bulb, at least one battery as a power source for illumination.

15. The illuminable toy device of claim 12 wherein said reflective sheet, said diffusion screen and said light source are located within said upper lid.

16. The illuminable toy device of claim 12 wherein said bottom container has a plurality of compartments for storing said beads.

* * * * *